US008205758B2

(12) United States Patent
Shih

(10) Patent No.: US 8,205,758 B2
(45) Date of Patent: Jun. 26, 2012

(54) SOCKET HOLDER

(76) Inventor: Tsai-Chien Shih, Taichung (TW)

( * ) Notice: Subject to any disclaimer, the term of this patent is extended or adjusted under 35 U.S.C. 154(b) by 665 days.

(21) Appl. No.: 11/565,756

(22) Filed: Dec. 1, 2006

(65) Prior Publication Data

US 2008/0128370 A1 Jun. 5, 2008

(51) Int. Cl.
*A47F 7/00* (2006.01)

(52) U.S. Cl. ..... 211/70.6; 206/378

(58) Field of Classification Search ..... 211/69, 211/70.6, 99, 60.1, 113; 206/349, 350, 443, 206/373, 376, 378; 24/3.11, 518, 543
See application file for complete search history.

(56) References Cited

U.S. PATENT DOCUMENTS 676,573 A * 6/1901 Bowers ..... 211/70.6
2,064,591 A * 12/1936 Toney ..... 24/543
3,604,071 A * 9/1971 Reimels ..... 24/543
3,629,912 A * 12/1971 Klopp ..... 24/457
4,378,068 A * 3/1983 Bell ..... 206/461
4,489,994 A * 12/1984 Williams ..... 312/119
4,858,302 A * 8/1989 Stribiak ..... 483/3
5,129,126 A * 7/1992 Huang ..... 24/3.11
5,361,463 A * 11/1994 Revis ..... 24/543
5,484,057 A * 1/1996 Tzu-Ching ..... 206/374
5,640,742 A * 6/1997 White et al. ..... 24/3.12
D386,215 S * 11/1997 White et al. ..... D20/43
5,713,467 A * 2/1998 Kao ..... 206/349
5,788,303 A * 8/1998 Chia-Hsiang ..... 294/143
5,906,350 A * 5/1999 Kao ..... 248/688
5,967,340 A * 10/1999 Kao ..... 211/70.6
5,975,297 A * 11/1999 Kao ..... 206/378
6,039,188 A * 3/2000 Lee ..... 206/758
6,079,559 A * 6/2000 Lee ..... 206/378
6,092,655 A * 7/2000 Ernst ..... 206/378
6,092,656 A * 7/2000 Ernst ..... 206/378
6,095,329 A * 8/2000 Kao ..... 206/378
6,098,799 A * 8/2000 Lee ..... 206/378
6,202,864 B1 * 3/2001 Ernst et al. ..... 211/70.6
6,250,466 B1 * 6/2001 Ernst ..... 206/378
6,364,109 B1 * 4/2002 Blackwell ..... 206/378
6,386,363 B1 * 5/2002 Huang ..... 206/378
6,401,923 B1 * 6/2002 Huang ..... 206/376
6,415,933 B1 * 7/2002 Kao ..... 211/70.6
6,450,338 B1 * 9/2002 Chen ..... 206/378
6,508,360 B1 * 1/2003 Chen ..... 206/378
6,644,474 B1 * 11/2003 Lai ..... 206/378
6,669,032 B2 * 12/2003 Kao ..... 211/70.6
6,698,600 B1 * 3/2004 Lee ..... 211/70.6
6,742,653 B2 * 6/2004 Kao ..... 206/373
6,902,058 B1 * 6/2005 Chang ..... 206/378
7,055,689 B2 * 6/2006 Chen ..... 206/376
7,066,339 B2 * 6/2006 Chiu et al. ..... 211/70.6
7,077,275 B2 * 7/2006 Kao ..... 211/70.6
7,080,733 B2 * 7/2006 Kao ..... 206/372
7,175,032 B2 * 2/2007 Ling ..... 211/70.6
7,210,578 B2 * 5/2007 Tuan-Mu et al. ..... 206/378

(Continued)

*Primary Examiner* — Darnell Jayne
*Assistant Examiner* — Joshua Rodden

(57) ABSTRACT

A holder is provided for holding sockets. The holder includes a body, a lateral cover and a locking device. The body includes a lateral plate and a plurality of inserts extended from the lateral plate. The lateral cover is pivotally connected to the body and formed with a plurality of bosses. Each insert is adapted to be inserted into a first recess defined in one end of a corresponding socket and a corresponding boss is adapted to be inserted into a second recess defined in another end of the same socket. The locking device is used to lock the lateral cover to the body, thus locking the sockets in the holder.

5 Claims, 12 Drawing Sheets

U.S. PATENT DOCUMENTS

2003/0024837 A1* 2/2003 Chen ..... 206/378
2003/0070999 A1* 4/2003 Kao ..... 211/70.6
2003/0102275 A1* 6/2003 Kao ..... 211/70.6
2003/0213760 A1* 11/2003 Lee ..... 211/70.6
2004/0149608 A1* 8/2004 Laux et al. ..... 206/349

* cited by examiner

SOCKET HOLDER

BACKGROUND OF INVENTION

1. Field of Invention

The present invention relates to sockets and, more particularly, to a holder for sockets.

2. Related Prior Art

In early days, a box-ended or open-ended wrench includes a head of a fixed size for driving a threaded bolt or nut of a fixed size. Wrenches of various sizes must be prepared for threaded bolts and nuts of various sizes. Many wrenches occupy a lot of space and weigh a lot. It is inconvenient to carry and store a lot of wrenches. Moreover, many wrenches cost a user much money.

Later, socket wrench sets are devised. A socket wrench set includes a handle and sockets of various sizes. Each of the sockets includes an end for engagement with a threaded bolt or nut of a certain size and an opposite end for engagement with the handle. Thus, threaded bolts and nuts of various sizes can be driven by a socket wrench set.

Such sockets will be worn away or lost and must be replaced with new ones. Sockets of various sizes are often disposed in a container so that they can be shown to and bought by customers. They however could easily be stolen.

There are devised holders for sockets. A holder includes a plastic body for holding a socket and a burglarproof magnetic recorder secured to the plastic element for recording information. After money is paid for a socket, the information recorded in the related burglarproof magnetic recorder will be modified. Otherwise, the burglarproof magnetic recorder will trigger an alarm when moved past a burglarproof magnetic sensor located at an exit of a shop or mall. Such a holder is however good for holding only one socket and useless for holding various sockets neatly. Moreover, a holder will be used and must be disposed of after it is removed from a socket.

The present invention is therefore intended to obviate or at least alleviate the problems encountered in prior art.

SUMMARY OF INVENTION

It is the primary objective of the present invention to provide a holder for securely holding sockets in a shop or mall and neatly holding the sockets at home, factory or workshop.

According to the present invention, a holder is provided for holding sockets. The holder includes a body, a lateral cover and a locking device. The body includes a plurality of recesses defined therein for adapting to respectively receive a plurality of sockets. The body has a lateral plate being adjacent to the plurality of recesses. A plurality of inserts are extended from the lateral plate. The body has a body recess defined therein. The body recess has a body ridge formed on an inner periphery thereof. The lateral cover is pivotally connected to the body. A plurality of bosses are formed on the lateral cover for corresponding to the plurality of inserts. Each insert is adapted to be inserted into a first recess defined in one end of a corresponding socket and a corresponding boss adapted to be inserted into a second recess defined in another end of the same socket. The locking device is provided for detachably inserting into the body recess for locking the lateral cover to the body such that the sockets are locked in the holder. The locking device has an arch formed thereon for inserting into the body recess. The arch includes an upper member and a lower member extended from the upper member. The upper member of the arch has a ridge formed thereon for engaging the body ridge. The upper member has a locking groove defined therein and a button formed thereon. The button is adjacent to the locking groove. The lower member has a tongue extended therefrom for pivotally selectively trapping in the locking groove.

Other objectives, advantages and features of the present invention will become apparent from the following description referring to the attached drawings.

BRIEF DESCRIPTION OF DRAWINGS

The present invention will be described through detailed illustration of the preferred embodiment referring to the drawings.

DETAILED DESCRIPTION OF PREFERRED EMBODIMENT

Figure 1:
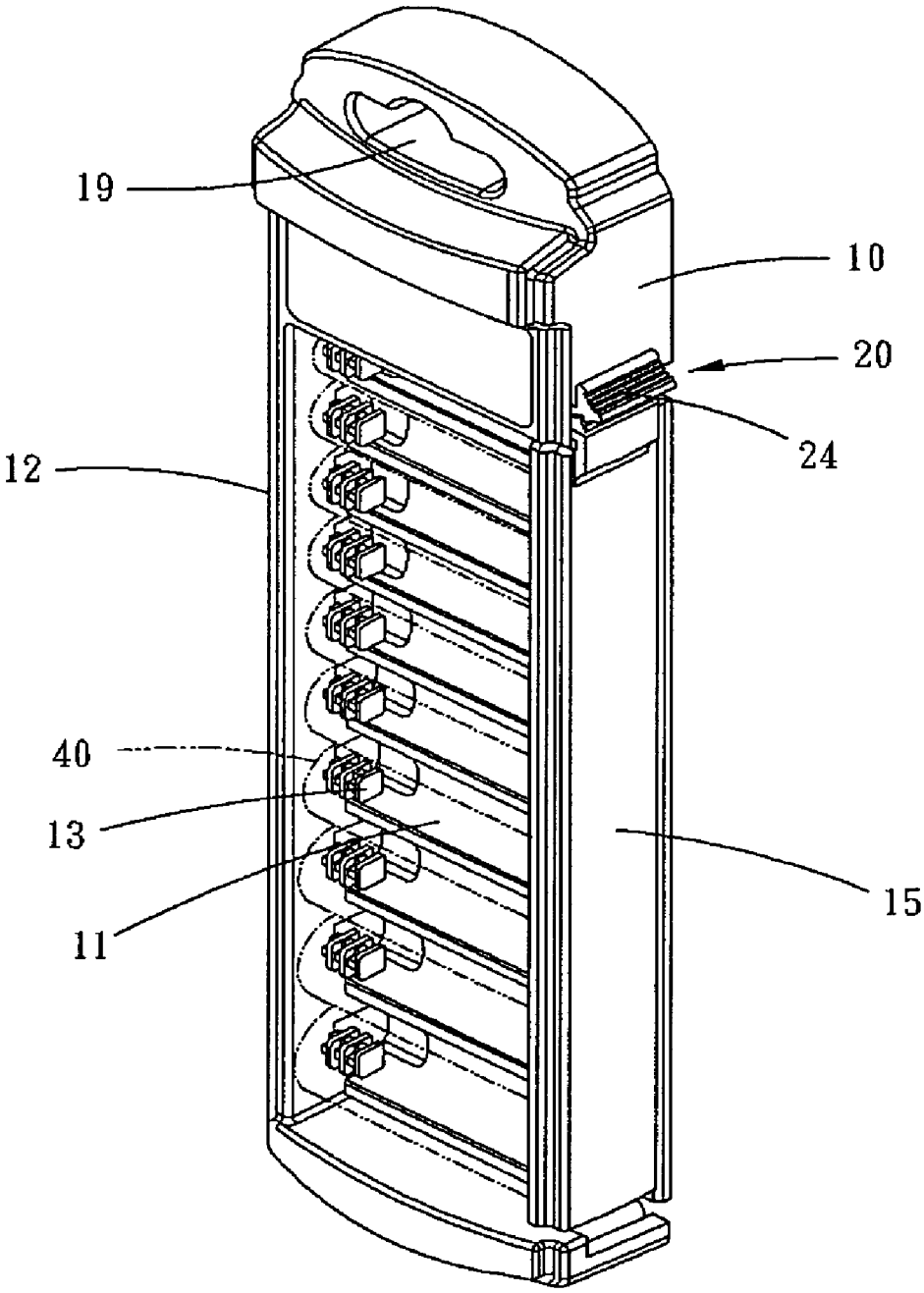
FIG. 1 is a perspective view of a holder according to the preferred embodiment of the present invention.
Figure 2:
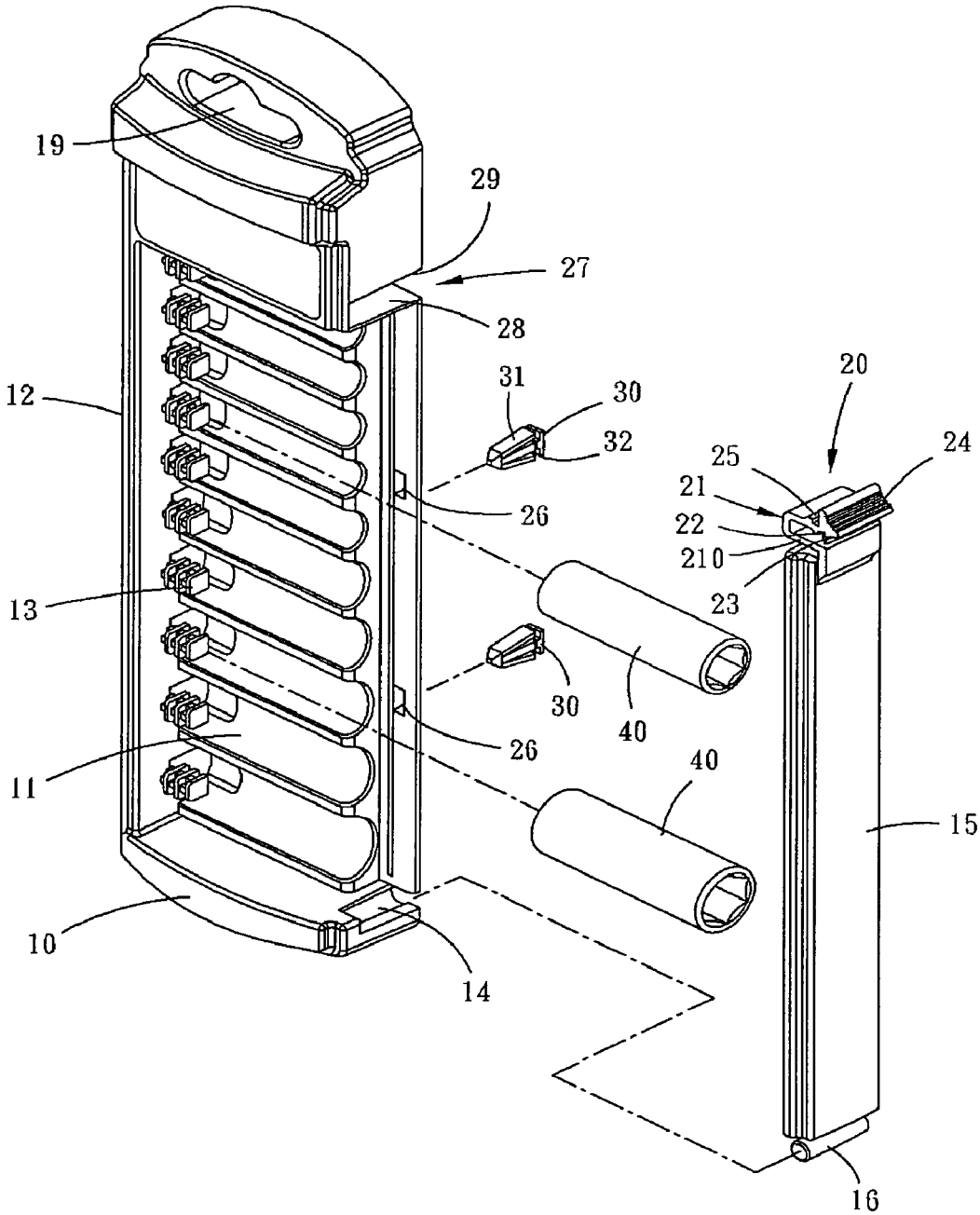
FIG. 2 is an exploded view of the holder shown in FIG. 1.
Figure 3:
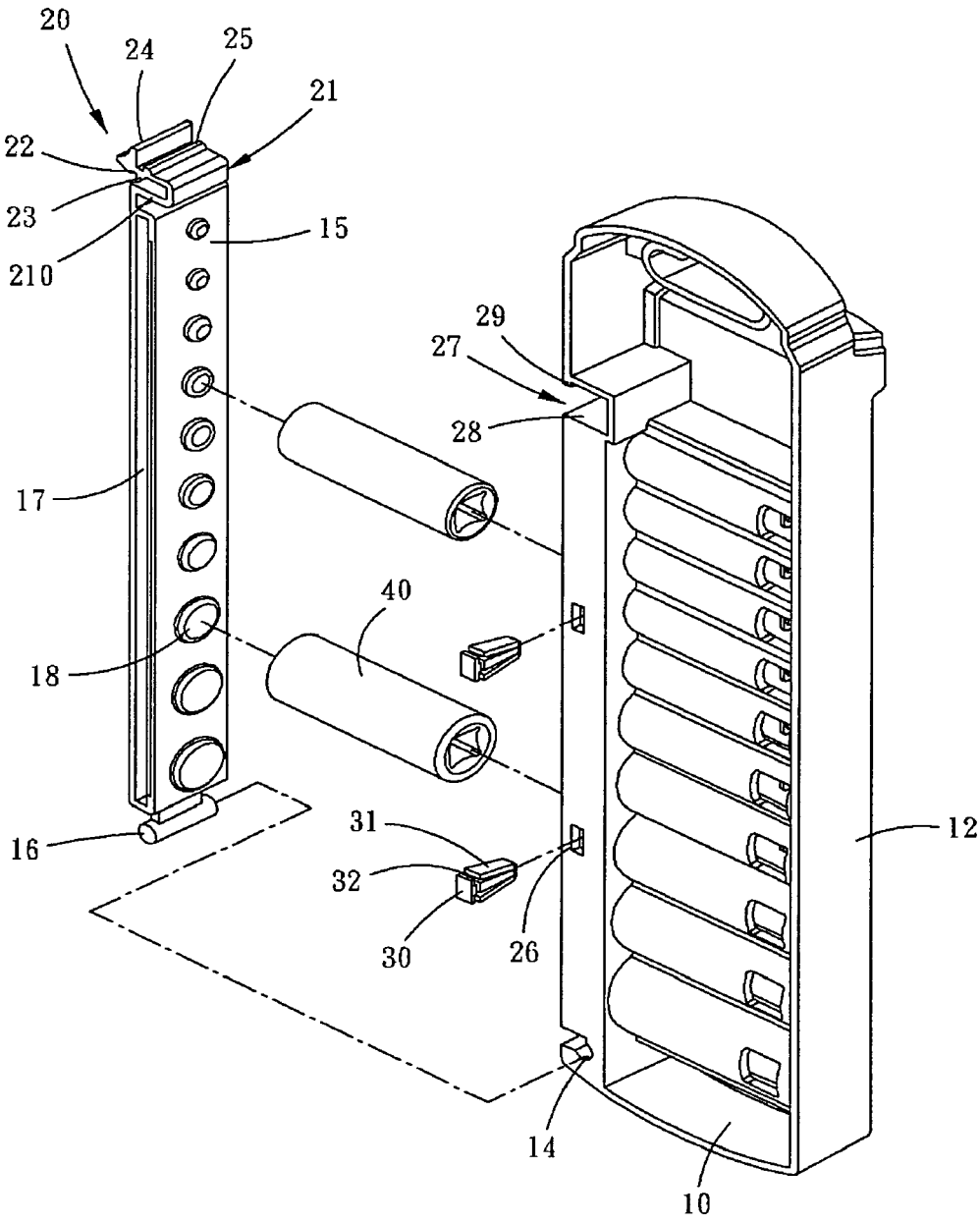
FIG. 3 is another exploded view of the holder shown in FIG. 1.
Figure 4:
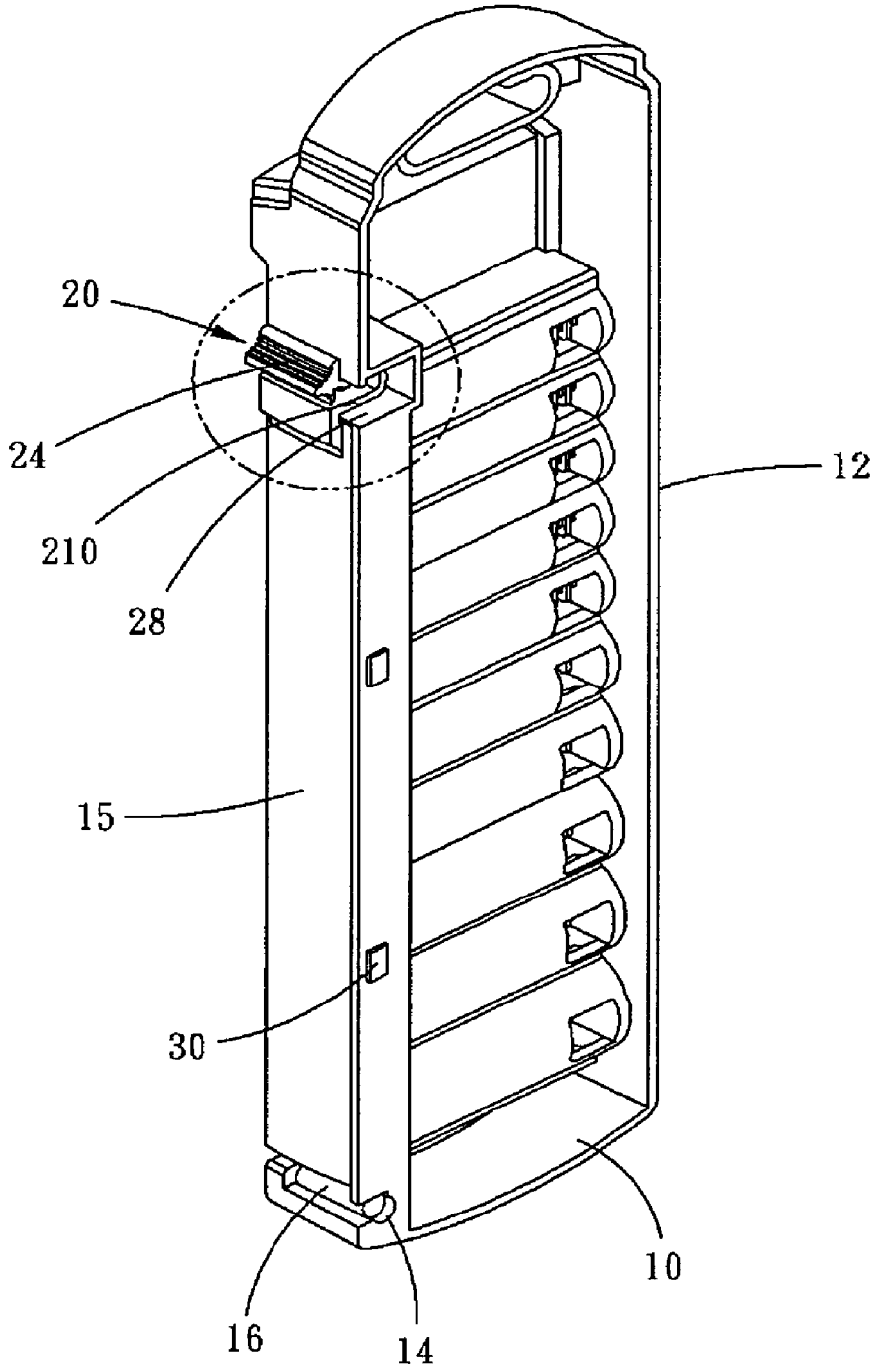
FIG. 4 is another perspective view of the holder shown in FIG. 1.

Referring to FIGS. 1 through 4, there is shown a holder according to the preferred embodiment of the present invention. The holder is used to hold sockets 40 of various sizes.

The holder includes a body 10 and a lateral cover 15. The body 10 includes a back plate, an upper board formed on the back plate, a lower board formed on the rear wall and a lateral plate 12 extended from the back plate. The lateral cover 15 can be connected to the body to in a manner to be described, thus forming a box.

The back plate includes a thick portion and a thin portion extended from the thick portion. The thick portion of the back plate defines recesses 11 of various sizes for receiving the sockets 40. The thin portion of the back plate defines apertures 26. The lateral plate 12 is adjacent to the recesses 11.

A plurality of inserts 13 are formed on the lateral plate 12.

The upper board defines a body recess 27 between a lower face and an upper face. The lower face of the body recess 27 is used as a contact face 28. A body ridge 29 is formed on an inner periphery of the upper face of the body recess 27. A handle is formed on the upper board, thus defining an opening 19 between them for receiving a hook or a nail secured to a wall so that the holder can be hung on the wall.

A pivoting recess 14 is defined in the lower board.

The lateral cover 15 includes a pivot 16 at a lower end, a locking device 20 at an upper end, a cover groove 17 defined along a rear edge and a plurality of bosses 18 of various sizes formed on a side for corresponding to the plurality of inserts. Each insert 13 is adapted to be inserted into a first recess defined in one end of a corresponding socket 40 and a corresponding boss 18 is adapted to be inserted into a second recess defined in another end of the same socket 40.

Figure 10:
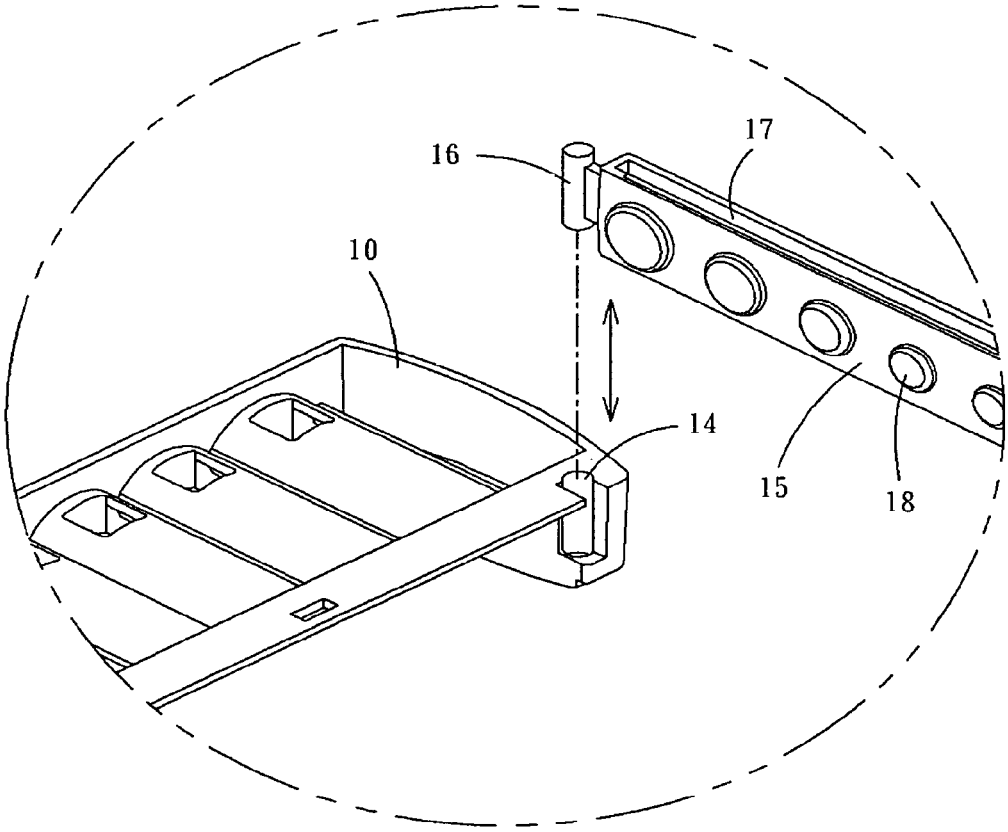
FIG. 10 is a partial view of the holder shown in FIG. 1.
Figure 11:
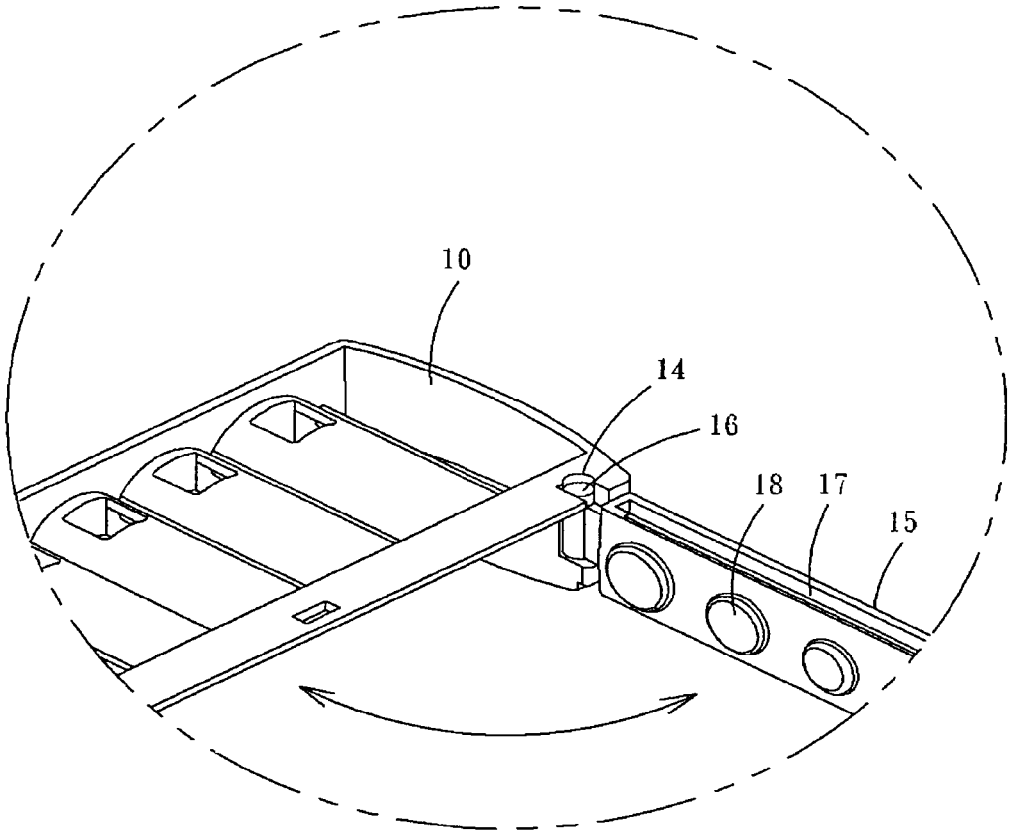
FIG. 11 shows the holder in another position than shown in FIG. 10.
Figure 12:
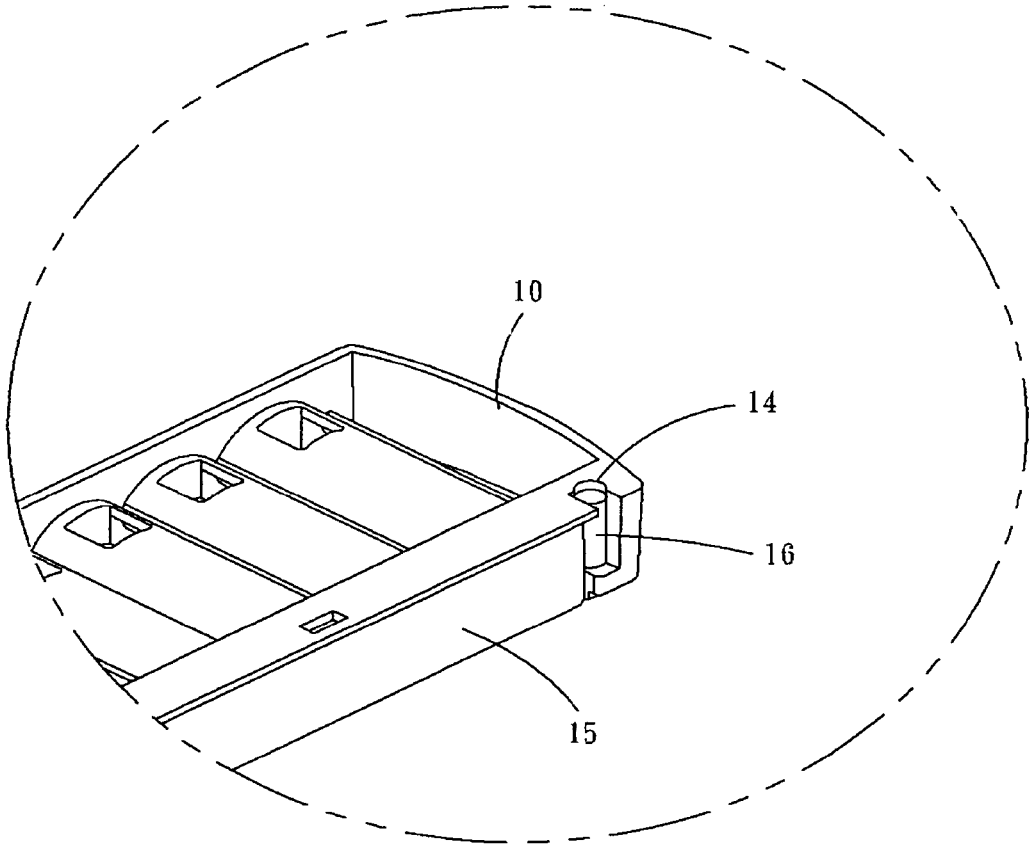
FIG. 12 shows the holder in another position than shown in FIG. 11.

Referring to FIGS. 10 through 12, the pivot 16 can be inserted into the pivoting recess 14, thus pivotally connecting the lateral cover 15 to the body 10.

The locking device 20 includes an arch 21 with an upper member and a lower member for inserting into the body recess 27 for locking the lateral cover 15 to the body 10. A button 24 is formed on the top of the upper member of the arch 21. A ridge 25 is formed on the top of the upper member of the arch 21. A locking groove 22 is defined in the bottom of the upper member of the arch 21 and adjacent to the button 24. A tongue 23 is formed on the top of the lower member of the arch 21 for pivotally selectively trapping in the locking groove. The tongue 23 can be pivoted into and from the locking groove 22 as shown in FIGS. 4 through 9. The bottom of the lower member of the arch 21 is used as a contact face 210.

There are pins 30 each including a central member and two retroflex lateral members 31 separated from the central member by two slits 32. The pins 30 can be inserted in the cover groove 17 through the apertures 26, thus locking the lateral cover 15 to the body 10.

Figure 6:
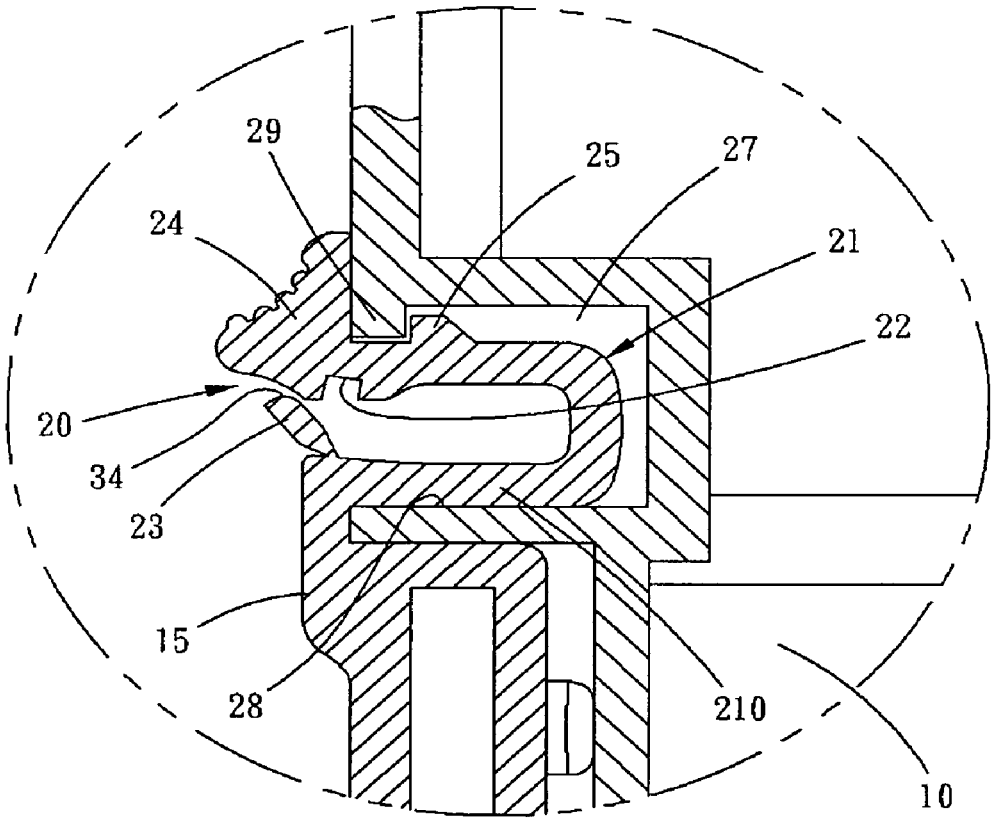
FIG. 6 is an enlarged partial cross-sectional view of the holder shown in FIG. 1.

Referring to FIG. 6, the arch 21 is inserted in the body recess 27. The ridge 25 is engaged with the body ridge 29. The contact face 210 is in contact with the contact face 28. The tongue 23 is formed with a chamfered portion 34 on a side. The lower face of the upper member of the arch 21 includes a chamfered portion. Thus, the tongue 23 can easily be pivoted into the locking groove 22, past the upper member of the arch 21.

Figure 5:
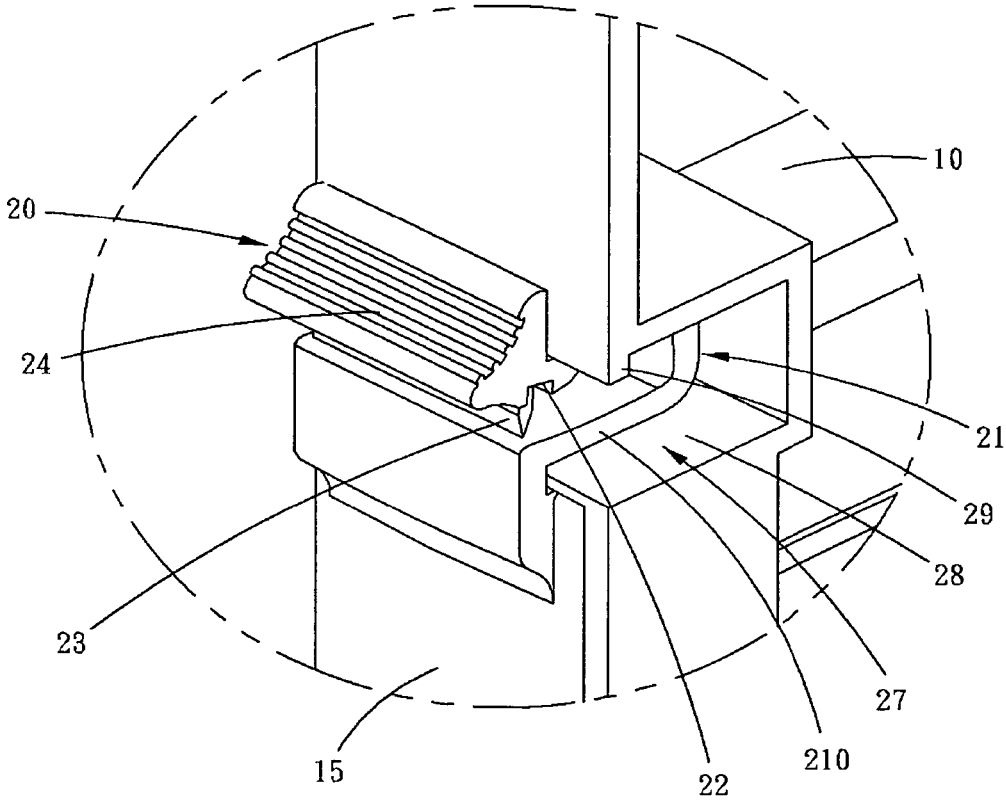
FIG. 5 is an enlarged partial view of the holder shown in FIG. 4.
Figure 7:
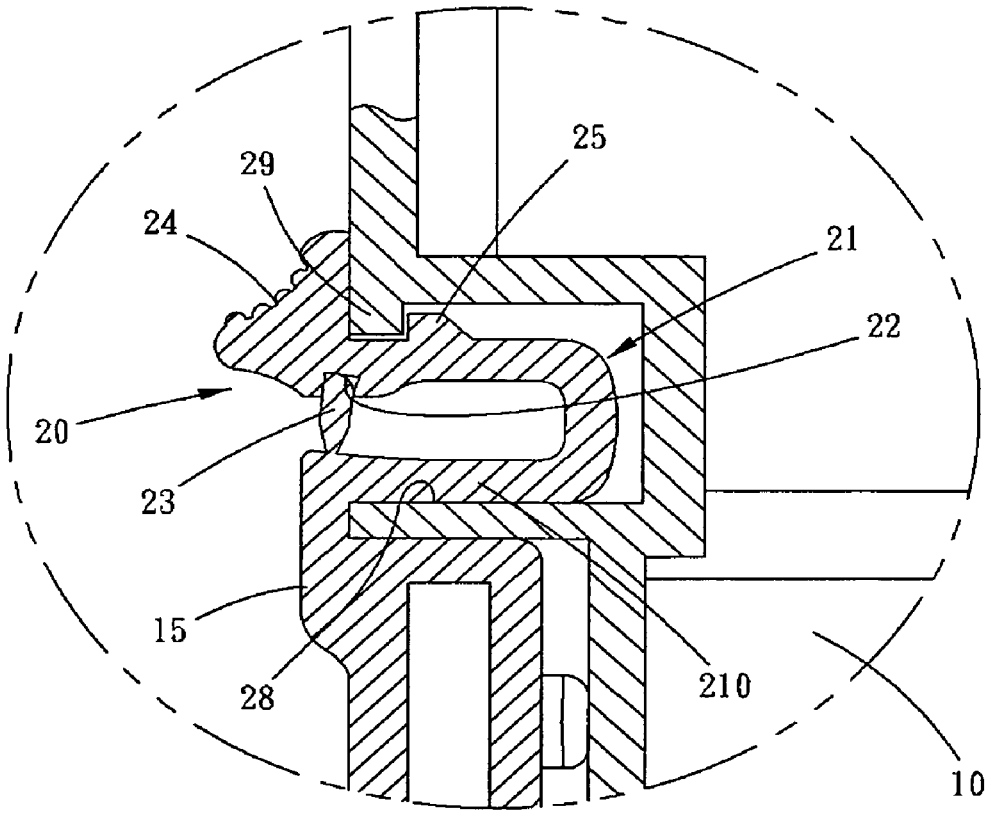
FIG. 7 shows the holder in another position than shown in FIG. 6.

Referring to FIGS. 5 and 7, the tongue 23 is trapped in the locking groove 22 so that the arch 21 is locked in the body recess 27 for providing a thief-proof effect. Therefore, the ridge 25 is firmly engaged with the body ridge 29 and the lateral cover 15 is locked to the body 10. That is, the sockets 40 are locked to the holder.

Figure 8:
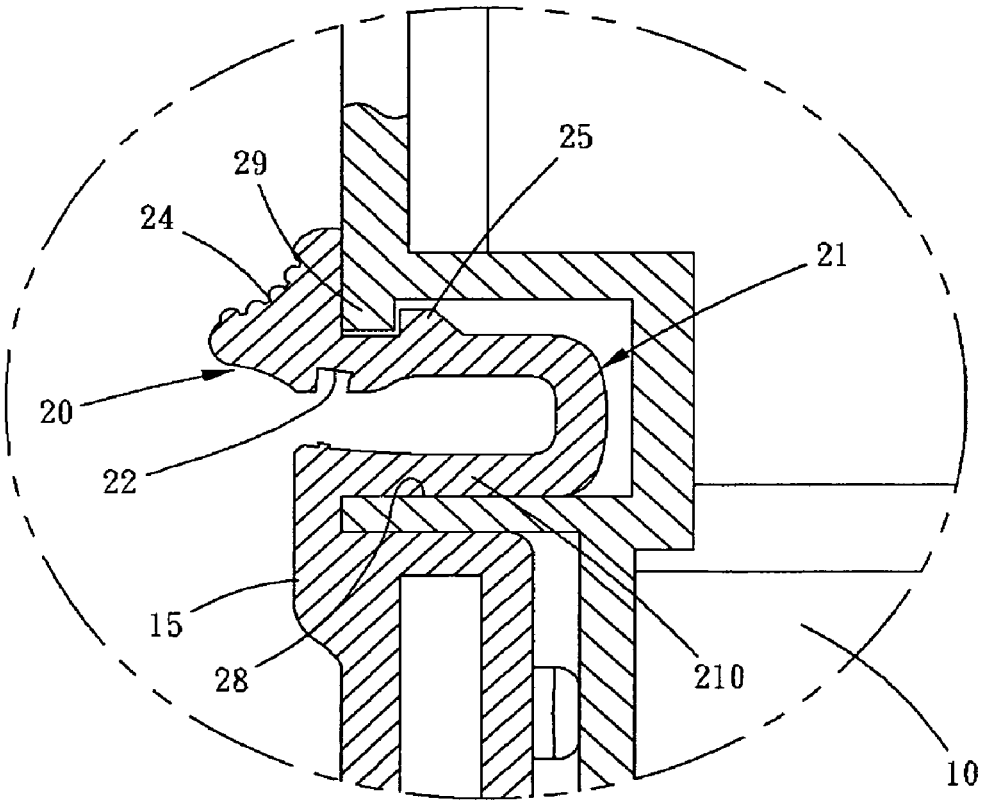
FIG. 8 shows the holder in another position than shown in FIG. 7.

Referring to FIG. 8, the tongue 23 is cut after the sockets 40 held by the holder are bought for example.

Figure 9:
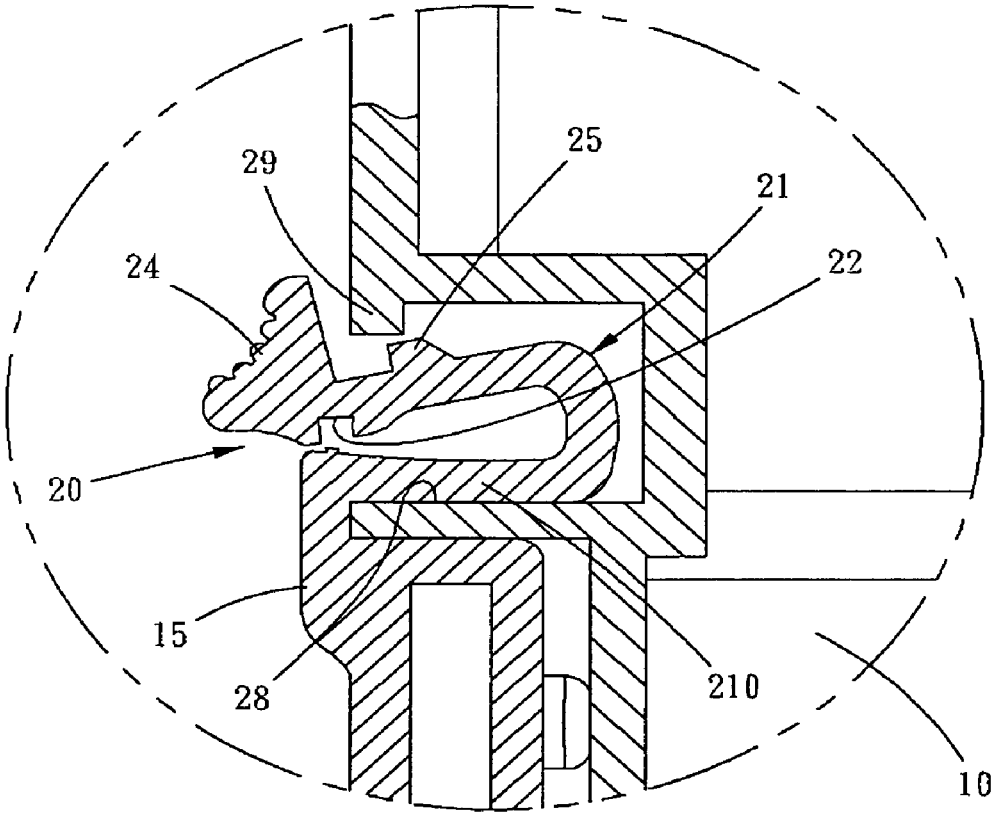
FIG. 9 shows the holder in another position than shown in FIG. 8.

Referring to FIG. 9, the upper member of the arch 21 can be pivoted towards the lower member again. The ridge 25 can be disengaged from the body ridge 29. The arch 21 can be removed from the body recess 27. The lateral cover 15 can be pivoted from the body 10. That is, the sockets 40 can be used.

The present invention has been described through the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A holder for holding sockets, the holder comprising;

a body comprising a plurality of recesses defined therein for adapting to respectively receive a plurality of sockets, the body having a lateral plate being adjacent to the plurality of recesses, a plurality of inserts extended from the lateral plate, the body having a body recess defined therein, the body recess having a body ridge formed on an inner periphery thereof;

a lateral cover pivotally connected to the body, a plurality of bosses formed on the lateral cover for corresponding to the plurality of inserts, wherein each insert is adapted to be inserted into a first recess defined in one end of a corresponding socket and a corresponding boss is adapted to be inserted into a second recess defined in another end of the same socket; and a locking device disposed on one end of the lateral cover, the locking device provided for detachably inserting into the body recess for locking the lateral cover to the body such that the sockets are locked in the holder, the locking device having an arch formed thereon for inserting into the body recess, the arch comprising an upper member and a lower member extended from the upper member, the upper member of the arch having a ridge formed thereon for engaging the body ridge, the upper member having a locking groove defined therein and a button formed thereon, the button being adjacent to the locking groove, the lower member having a tongue extended therefrom for pivotally selectively trapping in the locking groove;

wherein when the arch is inserted into the body recess and the tongue is non-slidably trapped in the locking groove, the ridge is firmly engaged with the body ridge and the lateral cover is firmly locked on the body for adapting to hold the sockets in the holder;

when the arch is inserted into the body recess and the tongue is cut/detached from the locking groove, the ridge is loosely engageable with the body ridge and the locking device is detachable for adapting to detach the sockets from the holder.

2. The holder according to claim 1 wherein the body defines an opening adapted to receive an object secured to a wall so that the holder can be hung on the wall.

3. The holder according to claim 1 wherein the body defines a further recess, and the lateral cover comprises a pivot inserted in said further recess for pivotally connecting the lateral cover to the body.

4. The holder according to claim 1 wherein the tongue comprises a chamfered portion for sliding against the upper member of the arch on the way into the groove.

5. The holder according to claim 1 comprising a pin, wherein the body defines an aperture, and the lateral cover defines a groove; the pin is inserted in the groove through the aperture so that the lateral cover is locked to the body.

* * * * *